United States Patent [19]

Harrison

[11] 4,248,581

[45] Feb. 3, 1981

[54] SPINNERETTE

[75] Inventor: David M. Harrison, Chester, Va.

[73] Assignee: Allied Chemical Corporation, Morris Township, Morris County, N.J.

[21] Appl. No.: 72,753

[22] Filed: Sep. 5, 1979

[51] Int. Cl.[3] ..... A01J 21/00

[52] U.S. Cl. ..... 425/464; 264/176 F; 425/72 S

[58] Field of Search ..... 425/464, 72 S; 264/176 F

[56] References Cited

U.S. PATENT DOCUMENTS

| | | | |
|---|---|---|---|
| 2,273,105 | 2/1942 | Heckert | 264/176 F |
| 3,100,675 | 8/1963 | Westerhuis et al. | 264/176 F |
| 3,113,012 | 1/1964 | Kilian | 264/176 F |
| 3,135,811 | 6/1964 | Barnett et al. | 264/176 F |
| 3,280,424 | 10/1966 | Heijnis | 264/176 F |
| 3,293,696 | 12/1966 | Bruni | 264/176 F |
| 3,335,210 | 8/1967 | Vinicki | 264/176 F |
| 3,487,142 | 12/1969 | Johnson et al. | 264/176 F |
| 3,508,390 | 4/1970 | Bagnall et al. | 264/176 F |
| 3,936,253 | 2/1976 | Fisher et al. | 264/176 F |
| 4,153,409 | 5/1979 | Capps et al. | 425/464 |

FOREIGN PATENT DOCUMENTS

| | | | |
|---|---|---|---|
| 44-903 | of 1969 | Japan . | |
| 846671 | 8/1960 | United Kingdom | 425/464 |
| 1220424 | 1/1971 | United Kingdom . | |

OTHER PUBLICATIONS

"Man-Made Fibers"-Manufacture, Encycl. of Polymer Sci. & Tech., vol. 8, p. 376, (1968).

*Primary Examiner*—Jay H. Woo

*Attorney, Agent, or Firm*—Virginia S. Andrews

[57] ABSTRACT

A spinnerette (60, 70, 80) is provided for use in a process in which one or more ends of individual filaments are extruded from a plurality of orifices (61, 71, 81) of the spinnerette (60, 70, 80). The orifices of each end are arranged in a pattern which bounds a predetermined area of the spinnerette. The pattern consists of at least 5 substantially parallel rows, the orifices being equispaced within a given row for substantially all of the rows. The perpendicular distance between rows going from one side of the pattern to the other on an average progressively increases per row by a percentage, preferably about 1 to 10 percent, of the orifice spacing on the row closest to a line parallel to the rows and bisecting the pattern.

19 Claims, 4 Drawing Figures

SPINNERETTE

BACKGROUND OF THE INVENTION

1. Field of the Invention

The present invention relates to the melt spinning of multifilamentary yarn from synthetic organic polymer, and more particularly, to a spinnerette for use in a melt spinning process.

2. The Prior Art

In the melt spinning of multifilamentary yarn from synthetic organic polymer, the molten polymer is extruded with the aid of a spinning pump or some other device through one or more spinnerette orifices, each of which produces a filament. The continuous, molten filaments then pass through a quench zone where a stream of fluid such as air is passed across the path of the filaments to cool or solidify them.

Uniform, turbulence-free quenching of filaments is an important factor in the production of filaments having uniform physical properties, a prerequisite to acceptable performance of fibers in subsequent processes. This is difficult to achieve in a cross flow quench system, typically linked to a high throughput and high filament density melt spin process, as the transverse path of the quenching fluid causes it to contact first one side of the filament bundle and then pass therethrough. Those filaments most remote (downstream) from the entry of the quench fluid are cooled or solidified by a quench flow which has been preheated, made more turbulent and substantially diminished (via a downward moving boundary layer) by the obstruction presented by filaments closer to and previously contacted by the quench fluid. As a consequence, the cooling rate of the filaments is progressively slower as quench fluid passes through the filament bundle. In a staple spinning operation where the filaments have a modified, e.g., Y, cross-section, this effect is seen as higher fused filament level and lower modification ratio in filaments downstream of (more remote from) the quench fluid entry. Filament fusion results from collision of filaments prior to solidification and causes an undesirable fabric hand as well as uneven dyeing. The modification ratio of a Y-shaped filament is the ratio of the radius of the circle circumscribing the entire filament to the radius of the circle inscribed within the filament cross-section and excluding the legs of the Y. The uniformity of the modification ratio is an indication of the uniformity of quench. The modification ratio is higher for filaments cooled closer to the extrusion orifice (faster cooling rate), and the shape of the filament more closely approximates the shape of the spinnerette orifice; the more slowly cooled filaments have a lower modification ratio and the shape of the filament more closely approaches round.

The ideal solution to quench irregularity would be to increase the spacing of spinnerette orifices, resulting in increased distance between filaments for quenching. However, these are practical restraints to the increase in orifice spacing in a spinnerette of given diameter and orifice count. The prior art has attempted to solve quench irregularity by arranging spinnerette orifices in substantially "V" patterns (U.S. Pat. Nos. 3,293,696 to Bruni and 3,335,210 to Vinicki), concentric circles and crescent formations (U.S. Pat. No. 3,135,811 to Barnett et al.), rectangular grids, and irregular arrangements whereby the spinnerette orifices are staggered so that each one is located in the quench flow path without obstruction (U.S. Pat. Nos. 2,273,105 to Heckert and 3,280,424 to Heijnis). The closest prior art is believed to be U.S. Pat. No. 3,100,675 to Westerhuis et al. which discloses that it is essential that the spinnerette orifices be arranged in parallel rows, that the orifices in a given row be equally spaced, and that the distance between adjacent rows be less than the distance between the orifices in each row.

SUMMARY OF THE INVENTION

The present invention provides a spinnerette for use in a process in which one or more ends of individual filaments are extruded from a plurality of orifices of the spinnerette. The orifices for each end are arranged in a pattern which fills a predetermined area of the spinnerette. Each pattern consists of at least 5 substantially parallel rows, the orifices being equispaced within a given row for substantially all of the rows. The perpendicular distance between rows going from one side of the pattern to the other on an average progressively increases per row by a percentage, preferably about 1 to 10 percent, of the orifice spacing on the row closest to a line parallel to the rows and bisecting the pattern.

When a single end is to be extruded from a spinnerette, it is preferred that the spacing of orifices per row going from the aforementioned side of the pattern to the other on an average progressively increases by from about 1 to 10 percent, most preferably by about 1 to 5 percent, of the orifice spacing. For extrusion of a single end, it is even more preferred that the orifice spacing range from about 0.10 to 0.75 inch (about 0.25 to 1.9 centimeters), and the orifices be positioned so that every other row has an orifice positioned at a distance from a line bisecting said pattern perpendicularly to the rows of within 25 to 50 percent of the spacing of the orifices on that row. It is also preferred that the perpendicular distance between rows, in this instance, progressively increases per row by about 1 to 5 percent of the orifice spacing. Note that the average increase can vary for the wide and narrow portions of the spinnerette. It is also most preferred that the orifices be positioned so that the alternate every other row has an orifice positioned on the line bisecting the pattern perpendicular to the rows, and that the pattern be symmetrical with respect to the line bisecting the pattern perpendicular to the rows.

As a practical matter, the number of orifices preferably ranges from 19 to 600, and when the bounded area is circular, its diameter preferably ranges from about 3 to 12 inches (about 7.62 to 30.48 centimeters); these values can vary, the actual limit being set by the particular orifice spacing. At an orifice spacing greater than about 0.75 inch, the advantage of the variable spaced patterning of orifices begins to diminish substantially.

In the most preferred embodiment of the present invention the pattern fills a circular area of the spinnerette for extrusion of a single end, and the arrangement of orifices is determined according to a method which consists essentially of the steps of:

(1) Solving for X in the equation:

$$3X^4+3X-(Nt-1)=0$$

where Nt is the number of spinnerette orifices;

(2) Determining the average orifice spacing Sa from:

$$Sa=D/2X$$

where D is the diameter of the circular area;

(3) Determining the average spacing between rows Sr from:

$$Sr = 1.05Sa;$$

(4) Determining the average spacing between orifices in the rows Sh from:

$$Sh = 0.95Sa;$$

(5) Determining each interval between rows ΔSr(w) for the wide portion from:

$$\Delta Sr(w) = (1 + 0.015N)Sr$$

where N is the number of rows away from the row closest to a line parallel to the rows and bisecting the pattern (the E-W axis);

(6) Determining each interval between rows ΔSr(V) for the narrow portion from:

$$\Delta Sr(V) = (1 - 0.035N)Sr;$$

(7) Determining the total distance Rn for each row from the line parallel to the rows and bisecting the pattern (the E-W axis) from:

$$Rn = \sum_{o}^{n} \Delta Sr;$$

(8) Determining the length Ln of each row from:

$$Ln = 2\sqrt{\left(\frac{D^2}{4}\right) - Rn^2};$$

(9) Determining the appropriate orifice spacing Sn on each row for the wide portion from:

$$Sn(w) = 0.95Sa(1 + 0.025N);$$

(10) Determining the approximate orifice spacing Sn on each row for the narrow portion from:

$$Sn(V) = 0.95Sa(1 - 0.025N);$$

(11) Determining the approximate number of orifices Nn on each row from:

$$Nn = (Ln/Sn) + 1;$$

(12) Rounding off Nn to the nearest whole number to obtain Nn(exact) consistent with the rule:
Nn(exact) is an even number for odd rows, and
Nn(exact) is an odd number for even rows, where the row closest to a line parallel to the rows and bisecting the pattern is considered the zero row, which is even, and the other rows are numbered therefrom for both the narrow and wide portions;

(13) Determining the exact orifice spacing Sn(exact) for each row from:

$$Sn(\text{exact}) = \frac{Ln}{Nn(\text{exact}) - 1}; \text{ and}$$

(14) Comparing Sn(exact) with the predicted Sn and if Sn(exact) and predicted Sn vary by greater than plus or minus 10 percent, then increasing or decreasing Nn to the next nearest whole number consistent with the rule of step 12.

While the present invention may be successfully used to produce fibers from various materials, it is particularly applicable to the production of synthetic polymer fibers. Throughout the present specification and claims, the term "yarn" is employed in a general sense to indicate strand material, either textile or otherwise, and including a continuous, often plied, strand composed of fibers, filaments, glass, metal, asbestos, paper or plastic, or a noncontinuous strand such as staple, and the like. A "filament" is defined as the tenuous strand material extruded from a single spinnerette orifice. An "end" is one or a contiguous group of such filaments. By "narrow portion" is meant that portion of the orifice pattern on the side of the row closest to a line which is parallel to the rows and which bisects the pattern, where the distance between rows on an average progressively decreases per row from the same row outwardly. By "wide portion" is meant that portion of the orifice pattern on the side of the row closest to a line which is parallel to the rows and which bisects the pattern, where the distance between rows on an average progressively increases per row from the selfsame row outwardly. By "average orifice spacing" is meant the center spacing of orifices on the row closest to a line parallel to the rows and bisecting the pattern for each end. The "spacing of orifices per row" refers to the center to center spacing of orifices within a given or named row.

The spinnerette orifice pattern and design basis therefor are described in detail for a circular spinnerette containing a single orifice pattern for use with cross flow quench. However, the design basis can be modified for multi-end circular spinnerettes, noncircular spinnerettes or for use with radial quench.

DESCRIPTION OF THE PREFERRED EMBODIMENT

Figure 1:
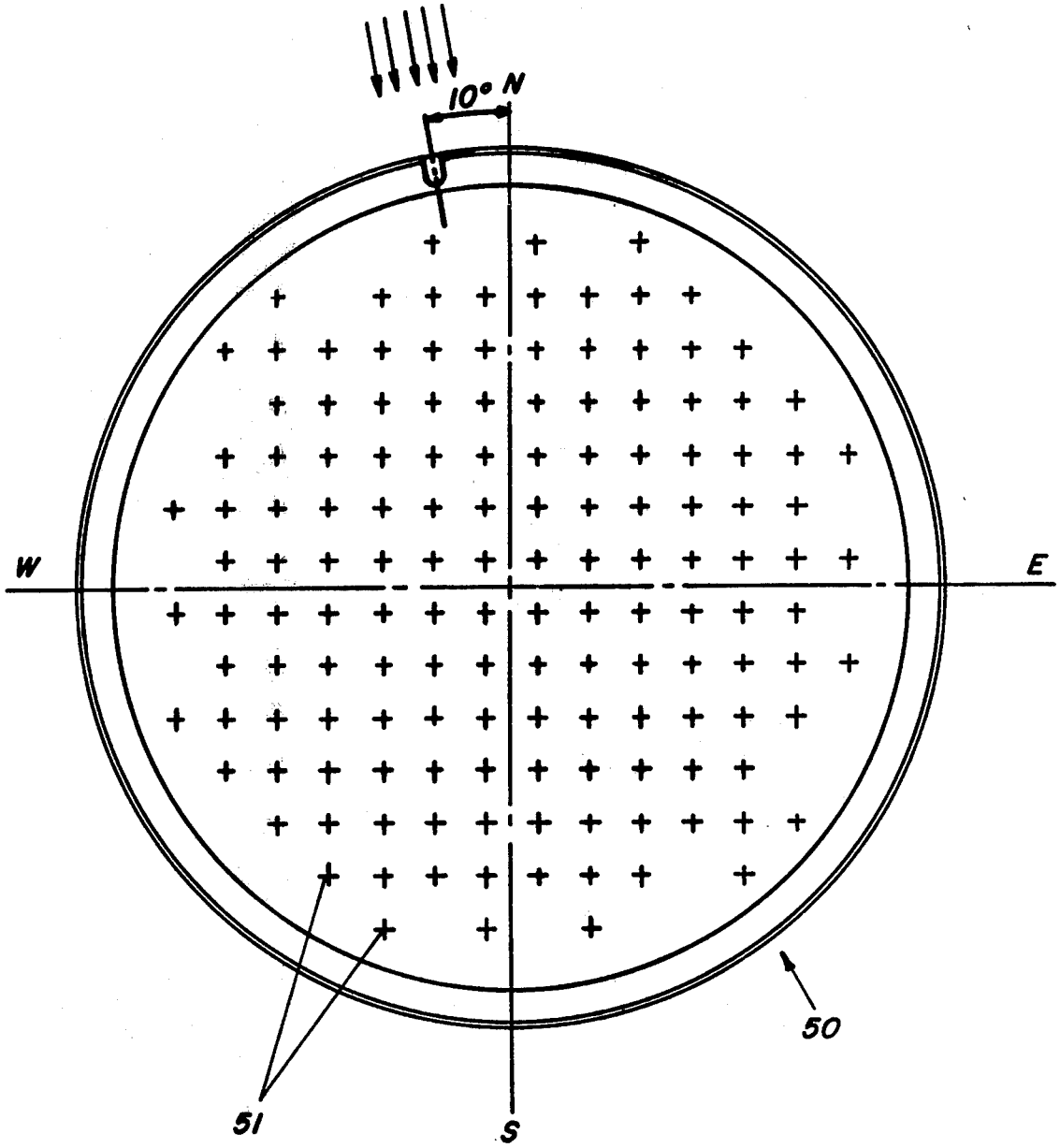
FIG. 1 (PRIOR ART)
FIG. 1 is a bottom view of a spinnerette of the prior art.

In the accompanying drawings, like numbers refer to like apparatus. With reference to FIG. 1, the orifices 51 of a prior art spinnerette 50 are uniformly spaced in a block pattern, the pattern being based on a grid formed by the intersection of a series of lines parallel to the E-W axis of the spinnerette with a series of lines parallel to the N-S axis of the spinnerette. The row spacing progressing N to S is equal; the orifice spacing progressing E to W is substantially equal. Quench fluid flow is cross-flow in the direction indicated by the arrows, i.e., at an angle of 10° counterclockwise with respect to the N-S axis.

Figure 2:
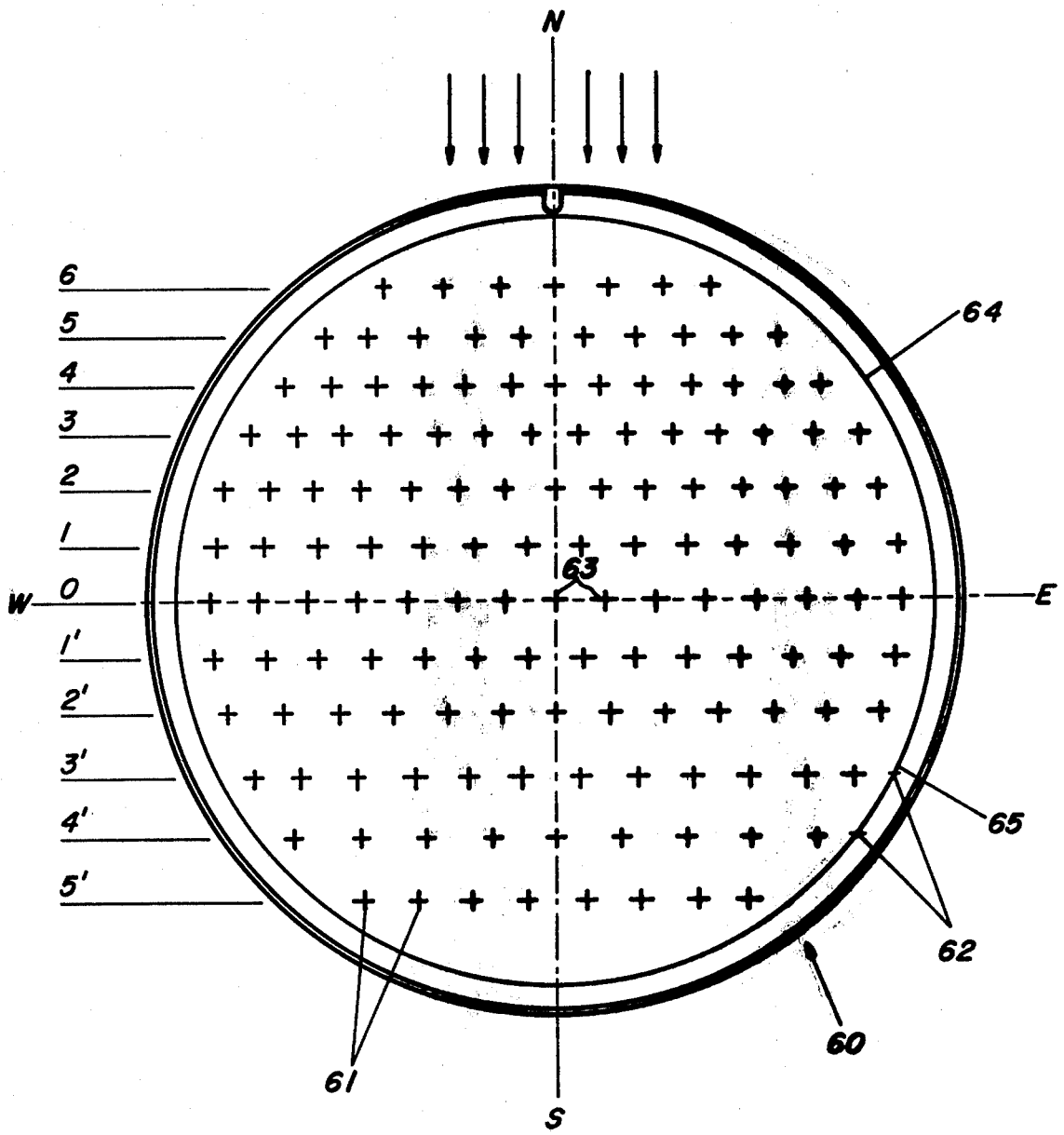
FIG. 2 is a bottom view of a spinnerette according to the present invention.

FIG. 2 depicts a spinnerette 60 wherein orifices 61 are in a fully variable pattern. The pattern consists of at least 5, in this instance 12, substantially parallel rows 62 of orifices 61 which are parallel to the E-W axis of spinnerette 60. The rows of orifices have been numbered with 0 designating the row closest to a line parallel to the rows and bisecting the pattern (the E-W axis), and the rows progressing therefrom going from S to N being successively designated by the numerals 1 through 6, and the rows progressing therefrom going from N to S being successively designated by the numerals 1' through 5'. Thus, rows 1 through 6 are located in the narrow portion 64 of spinnerette 60 while rows 1' through 5' are located in the wide portion 65. The perpendicular distance between rows 62 going from one side of the pattern to the other, i.e., from N to S, on an average progressively increases per row by from about 1 to 10 percent of the orifice spacing 63 on row 0, i.e., the perpendicular distance from row 5 to row 4 represents an increase of from about 1 to 10 percent of orifice spacing 63 over the perpendicular distance from row 6 to row 5, etc. Orifices 61 are substantially equispaced within a given row 62. The spacing of orifices per row going from N to S on an average progressively increases from about 1 to 10 percent of orifice spacing 63, i.e., the spacing of orifices on a given row may not be greater than the spacing of orifices on the next adjacent row to the N thereof, but for the entire pattern of orifices, the spacing of orifices per row on an average will progressively increase from row to row going from N to S. Quench fluid flow is cross-flow in the direction indicated by the arrows, i.e., parallel to the N-S axis and perpendicular to the rows of orifices.

Figure 3:
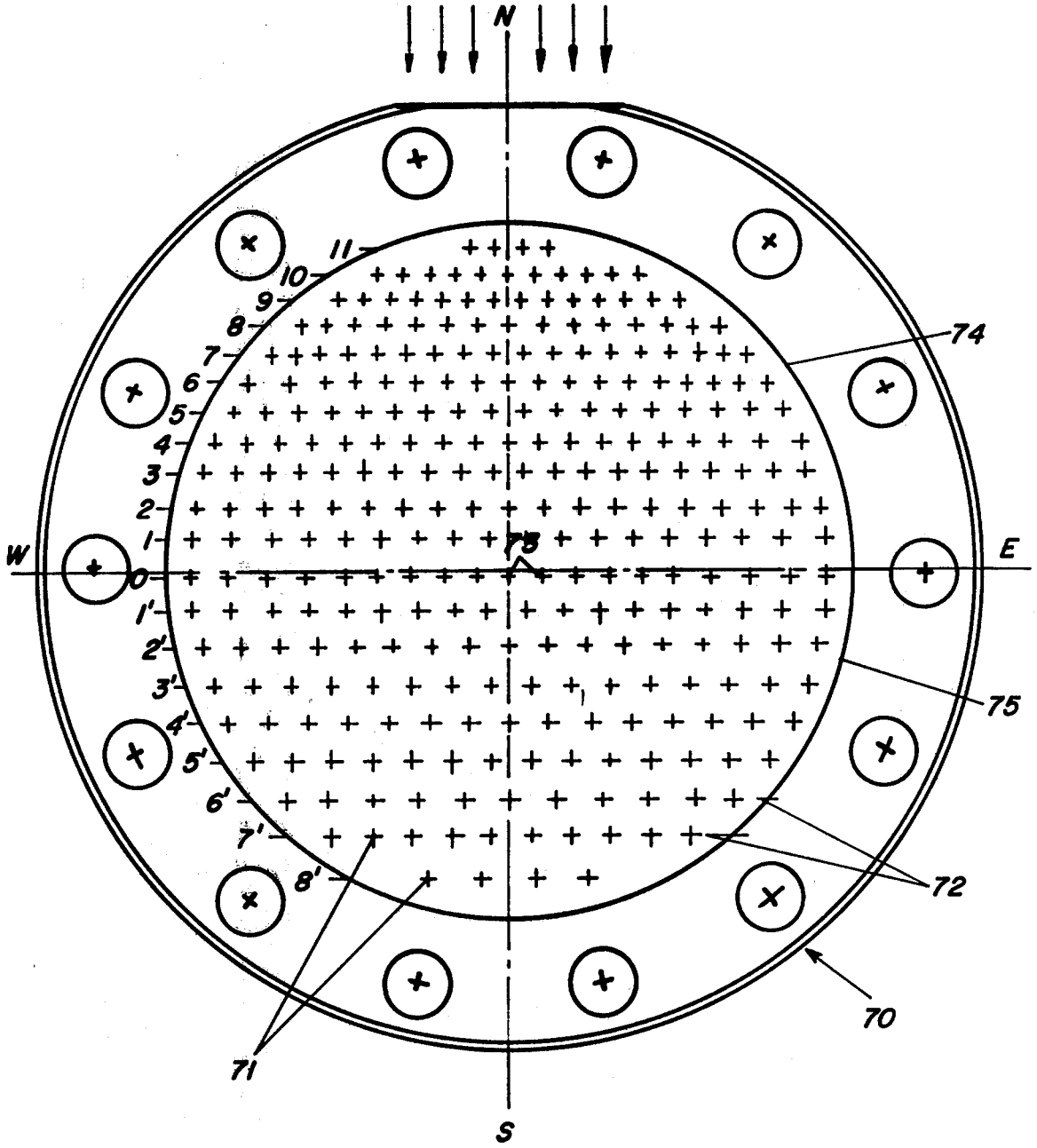
FIG. 3 is a bottom view of another spinnerette according to the present invention.

FIG. 3 depicts a spinnerette 70 wherein orifices 71 are also in a variable pattern. The pattern consists of at least 5, in this instance 20, substantially parallel rows 72 of orifices 71 which are parallel to the E-W axis of spinnerette 70. The rows of orifices have been numbered with 0 designating the row closest to a line parallel to the rows and bisecting the pattern (the E-W axis), and the rows progressing therefrom going from S to N being successively designated by the numerals 1 through 11, and the rows progressing therefrom going from N to S being successively designated by the numerals 1' through 8'. Thus, rows 1 through 11 are located in the narrow portion 74 of spinnerette 70 while rows 1' through 8' are located in the wide portion 75. The perpendicular distance between rows 72 going from one side of the pattern to the other, i.e., from N to S, on an average progressively increases per row by from about 1 to 10 percent of the orifice spacing 73 on row 0, i.e., the perpendicular distance between two adjacent rows may or may not be greater than that immediately to the N thereof, but for the entire pattern, the perpendicular distance between adjacent rows on an average will progressively increase going from N to S. Orifices 71 are equispaced within a given row 72. The spacing of orifices per row going from N to S on an average progressively increases from about 1 to 10 percent of orifice spacing 73, just as for spinnerette 60 of FIG. 2. Quench fluid is cross-flow in the direction indicated by the arrows, i.e., parallel to the N-S axis and perpendicular to the rows of orifices.

Figure 4:
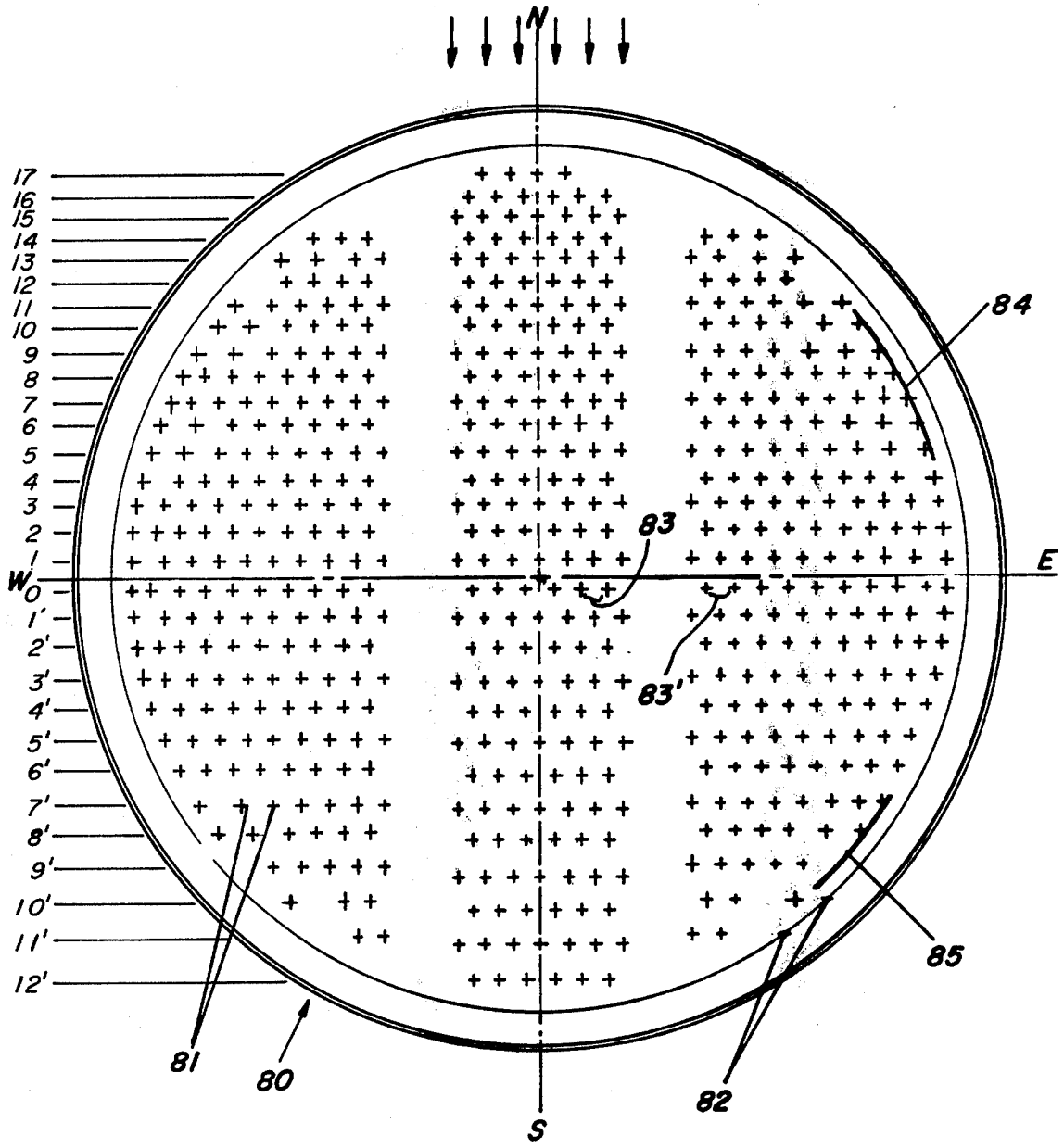
FIG. 4 is a bottom view of yet another spinnerette according to the present invention.

FIG. 4 depicts a spinnerette 80 wherein orifices 81 are arranged in three groups separated by two parallel imperforate sections of spinnerette 80. The center group, or pattern, consists of at least 5, in this instance 30, substantially parallel rows 82 of orifices 81 which are parallel to the E-W axis of spinnerette 80. The rows of orifices have been numbered with 0 designating the row closest to a line parallel to the rows and bisecting the pattern (the E-W axis), and the rows progressing therefrom going from S to N being successively designated by the numerals 1 through 17, and the rows progressing therefrom going from N to S being successively designated by the numerals 1' through 12'. Thus, rows 1 through 17 are located in the narrow portion 84 of spinnerette 80 while rows 1' through 12' are located in the wide portion 85. The perpendicular distance between rows 82 going from one side of the center group to the other, i.e., from N to S, on an average progressively increases per row by from about 1 to 10 percent of the orifice spacing 83 on row 0, i.e., the perpendicular distance from row 16 to row 15 represents an increase by a percentage of orifice spacing 83 over the perpendicular distance from row 17 to row 16; however, while this percentage increase may not be as great as 1 percent, on an average the perpendicular distance between the rows will increase per row by from 1 to 10 percent of orifice spacing 83. Orifices 81 are equispaced within a given row 82, and in the center group of orifices 81 of spinnerette 80, the spacing of orifices per row remains substantially the same. The left- and right-hand groups of orifices 81 are substantially symmetrical about the N-S axis and contain substantially the same number of orifices 81. Similar to the center group, the left- and right-hand groups of patterns, each consist of at least 5, in this instance 26, substantially parallel rows 82 of orifices 81, which are parallel to the E-W axis of spinnerette 80. The rows of orifices have been numbered as if spaced identical to the center group; in actuality, however, the spacings of rows 11 through 14 and 1' through 11' for the left- and right-hand groups are not identical to that of the same numbered rows for the center group as will be seen by reference to Example 3. The perpendicular distance between rows 82 going from one side of each of the left- and right-hand groups to the other, i.e., from N to S, on an average also progressively increases per row by from about 1 to 10 percent of the orifice spacing 82 on row 0. Quench fluid is cross-flow in the direction indicated by the arrows, i.e., parallel to the N-S axis and imperforate sections of spinnerette 80 and perpendicular to the rows of orifices.

Note that reference in the drawings and present specification to N-S and E-W axes and directions is meant only as an aid to understanding the present invention and should not be construed as limiting orientation of the spinnerettes to those compass directions. Further, although less preferred, it is possible to orient the depicted spinnerettes with their respective wide portions adjacent the quench fluid flow rather than the narrow portions.

The individual filaments of yarn can have any cross-sectional configuration such as round, oval, heart-shaped, hollow, Y-shaped, multilobal, polygonal, or mixtures thereof. The use of Y-shaped orifices is preferred as the beneficial effects of the present invention, specifically quench uniformity and the resultant interfilament uniformity, are highlighted by comparing modification ratio uniformity and fusion level of filaments formed by prior art spinnerettes and the spinnerette of the present invention. U.S. Pat. No. 3,508,390 to Bagnell et al., hereby incorporated by reference, shows and describes Y-shaped spinnerette orifices and filaments extruded therethrough; an explanation of modification ratio is also included.

The spinnerette orifice pattern of the present invention preferably fills and bounds a circular area of the spinnerette. Two variables, which are usually known and which are the starting point of any spinnerette design, are the total number of spinnerette orifices Nt and the spinnerette wetted diameter or diameter of the circular area D. The arrangement of orifices is determined according to a method which is set forth in the summary above as steps 1 to 14.

A small number of orifices may be added or, more preferably, deleted in order to achieve Nt. Deletion of orifices preferably occurs in the narrow portion of the spinnerette from rows closer to the quench fluid flow and on a symmetrical basis about the N-S axis. For simplicity, it is preferred that the design start at the center row 0 of orifices, which is preferably placed across the E-W axis of the orifice pattern with a center orifice through the pattern center. In the instance where a single end of filaments is to be extruded from a single spinnerette, the design preferably starts at the center row 0 of orifices, which is placed across the E-W axis of the spinnerette with a center orifice through the spinnerette center. The design basis can be modified for split or multi-end spinnerettes, and noncircular spinnerettes or for use with radial quench.

When the predetermined area of the spinnerette which is bounded (filled) by the pattern is circular, the orifice spacing preferably ranges from about 0.10 to 0.75 inch (about 0.25 to 1.9 centimeters), and the orifices are preferably positioned so that every other row has an orifice positioned at a distance from a line bisecting the pattern perpendicularly to the rows (the N-S axis) of within 25 to 50 percent of the spacing of the orifices on that row. It is also preferred that the orifices be positioned so that the alternate every other row has an orifice positioned on the line bisecting the pattern perpendicular to the rows (the N-S axis), and that the pattern be symmetrical with respect to the line bisecting the pattern perpendicular to the rows (the N-S axis). As a practical matter, the number of orifices preferably ranges from 19 to 600, and the diameter of the circular area ranges from about 3 to 12 inches (about 7.62 to 30.48 centimeters); these values can vary, the actual limit being set by the particular orifice spacing. Worthy of note is the proportionality of distances between rows and/or orifices for patterns comprised of the same number of spinnerette orifices Nt but different diameters D; the patterns look alike as the relative positions of orifices and rows remain the same, only the scale being different.

In the following examples, spinnerette orifice patterns are described in detail for circular spinnerettes which contain a single orifice pattern or three groups (patterns) of orifices for use with cross flow quench. These examples are given to illustrate the present invention and are not to be considered as limiting the scope of the invention.

EXAMPLE 1

Orifices 61 of spinnerette 60 of the present invention (see FIG. 2) were arranged in a pattern for the extrusion of a single end of yarn. The total number of orifices was 144, and the diameter of the wetted or circular area was 5.12 inches (13.0 cms.). TABLE I below sets forth for each row the number of orifices; the spacing between the orifices; the length of the row; the total distance from that row to the center line (E-W axis); and the interval between that row and the adjacent row closer to the row designated 0 (or the row 0), termed the row spacing.

TABLE I

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| 6 | 7 | 0.333/0.846 | 2.00/5.07 | 2.258/5.735 | 0.330/0.838 |
| 5 | 10 | 0.309/0.785 | 2.78/7.06 | 1.928/4.897 | 0.350/0.889 |
| 4 | 13 | 0.336/0.853 | 4.03/10.2 | 1.578/4.008 | 0.370/0.940 |
| 3 | 14 | 0.348/0.884 | 4.52/11.5 | 1.208/3.068 | 0.390/0.991 |
| 2 | 15 | 0.347/0.881 | 4.86/12.3 | 0.819/2.078 | 0.410/1.04 |
| 1 | 14 | 0.389/0.988 | 5.06/12.8 | 0.408/1.036 | 0.408/1.04 |
| 0 | 15 | 0.366/0.930 | 5.12/13.0 | —/— | —/— |
| 1' | 14 | 0.389/0.988 | 5.06/12.8 | 0.410/1.041 | 0.410/1.04 |
| 2' | 13 | 0.405/1.03 | 4.86/12.3 | 0.820/2.083 | 0.410/1.04 |
| 3' | 12 | 0.407/1.03 | 4.48/11.4 | 1.250/3.175 | 0.430/1.09 |
| 4' | 9 | 0.481/1.22 | 3.85/9.77 | 1.690/4.293 | 0.440/1.12 |
| 5' | 8 | 0.407/1.03 | 2.85/7.24 | 2.130/5.410 | 0.440/1.12 |

Note that row 0 was coincident with the E-W axis with an orifice 61 centered on the intersection of the N-S and E-W axes. Each even numbered row also had an orifice 61 centered on the N-S axis while the odd numbered rows had orifices symmetrically spaced about the N-S axis without any orifices on the N-S axis. Orifice spacing 63 was 0.366 inch (0.930 cm.). Orifices 61 were Y-shaped on the discharge face of spinnerette 60 with the axes of the legs of the Y approximately 120° apart, the length of each leg approximately 0.040 inch (0.102 cm.), and the width of each leg approximately 0.008 inch (0.020 cm.). Orifices 61 were oriented such that the axis of one leg coincided with the direction of quench fluid flow when spinnerette 60 was placed in the spin pot. In the narrow portion 64 of spinnerette 60 the perpendicular distance between rows going from N to S progressively increased per row an average of about 4.26 percent of orifice spacing 63; in the wide portion 65, the increase averaged about 1.75 percent of orifice spacing 63. The spacing of orifices per row going from N to S on an average progressively increased by about 1.84 percent of orifice spacing 63.

A polymer, having about 10±1.5 carboxyl end groups and about 53 amine end groups, a formic acid viscosity of about 55±2.0 and an extractables level of less than about 3.0, was supplied at a rate of 147.5 pounds per hour per position and at a temperature of about 262°±1° C. to a spinning position which comprised two spin pots each containing one spinnerette 60 as described above. The filaments were extruded from each spinnerette into a quench stack where the cross flow of quenching fluid was air at a temperature of about 60°±3° F. and at a relative humidity of about 65±3%. Orientation of the spinnerettes with respect to the quench flow was as shown in FIG. 2. Each end of quenched filaments had a spin finish applied and subsequently was deposited in a tow can. The undrawn denier of the yarn was about 46±1, the percent finish on yarn was about 0.8±0.2%, the percent moisture on yarn was about 5.0±1.0% and the modification ratio was between about 2.9 to 3.4. Subsequently, the yarn can be created to form a tow, stretched, crimped, cut, baled and crimp set.

Fiber produced with prior art spinnerettes 50 (FIG. 1) was used as a control. Each spinnerette 50 had a wetted area with a diameter of about 4.98 inches (12.7 cms.) and 144 Y-shaped orifices 51 having dimensions as previously set forth. The orifices were arranged in 14 parallel rows wherein the average row spacing was about 0.348 inch (0.884 cm.) and the average hole spacing was about 0.348 inch (0.884 cm.). Properties of the fiber produced are listed in Table II.

TABLE II

| Fiber Properties | Control Spinnerettes | Variable Spaced Spinnerettes |
|---|---|---|
| Denier | 17.4 | 17.6 |
| Elongation (%) | 68 | 66 |
| Breaking Strength (gms.) | 79 | 80 |
| Tenacity (gms.) | 4.5 | 4.6 |
| Fusion 10 gms. (%) | 1.33 | 0.33 |
| Modification Ratio Average | 3.1 | 3.1 |
| Modification Ratio Standard Deviation | 0.14 | 0.12 |

There were no problems associated with the variable spaced spinnerettes, e.g., drips, dog legs, carbon buildup, wiping, etc. Performance on the tow stretcher was good and equal to regular commodity product. With reference to TABLE II, properties of the fiber made with the variable spaced spinnerettes were equivalent to or better than that made with the control spinnerettes. Note that filament fusion was significantly lower with the variable spaced spinnerettes.

The 10-gram fusion test was performed as follows. Approximately one pound (454 grams) of cut staple fiber to be tested was carded. Approximately a 10-gram portion of the carded silver was removed for examination. The 10-gram sliver portion was weighed on a precision balance to the nearest 0.01 gram. The 10-gram silver portion has then spread apart slowly over a lighted shadow box. All filaments appearing heavier or darker were pulled from the mass and placed on a black velvet board. This procedure was continued until all heavy filaments had been removed. The removed heavy filaments were weighed on a precision balance to the nearest 0.0001 gram. The weight in grams of the heavy filaments was divided by the original 10-gram sliver portion weight, and the quotient was multiplied by 100 and reported as percent 10-gram fusion.

Further comparisons of the variable spaced spinnerettes and control spinnerettes were made using the 10-gram fusion test, and the comparisons indicated that the variable spaced spinnerettes showed a significant (approximately 58%) improvement over the control spinnerettes. The comparisons were based on samples taken from the process as previously described and also on samples taken from a similar process wherein the polymer had about 10±1.5 amine end groups and about 53 carboxyl end groups. Results are set forth in Table III.

TABLE III

| Sample Number | 10-Gram Fusion Test (%) Control Spinnerettes | Variable Spaced Spinnerettes |
|---|---|---|
| 1 | 4.28 | 1.36 |
| 2 | 2.05 | 1.79 |

TABLE III-continued

| Sample Number | 10-Gram Fusion Test (%) Control Spinnerettes | Variable Spaced Spinnerettes |
|---|---|---|
| 3 | 3.67 | 1.93 |
| 4 | 3.49 | 1.39 |
| 5 | 4.36 | 1.46 |
| 6 | 4.11 | 1.37 |
| Average | 3.66 | 1.55 |
| Standard Deviation | 0.86 | 0.25 |

It is readily apparent that the variable spaced spinnerettes of the present invention are an improvement with respect to fusion over regular spaced spinnerettes.

EXAMPLE 2

Orifices 71 of spinnerette 70 of the present invention (See FIG. 3) were arranged in a pattern for the extrusion of a single end of yarn. The total number of orifices was 300, and the diameter of the wetted or circular area was 7 inches (17.8 cms.) Table IV below sets forth for each row the number of orifices; the spacing between the orifices; the length of the row; the total distance from that row to the center line (E-W axis); and the interval between that row and the adjacent row closer to the row designated 0 (or the 0 row), termed the row spacing.

TABLE IV

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| 11 | 4 | 0.270/0.686 | 0.810/2.06 | 3.231/8.207 | 0.248/0.630 |
| 10 | 11 | 0.266/0.676 | 2.66/6.76 | 2.983/7.577 | 0.256/0.650 |
| 9 | 14 | 0.275/0.699 | 3.58/9.08 | 2.727/6.927 | 0.266/0.676 |
| 8 | 15 | 0.306/0.777 | 4.28/10.9 | 2.461/6.251 | 0.276/0.701 |
| 7 | 18 | 0.285/0.724 | 4.85/12.3 | 2.185/5.555 | 0.291/0.739 |
| 6 | 19 | 0.295/0.747 | 5.29/13.4 | 1.894/4.811 | 0.291/0.739 |
| 5 | 18 | 0.333/0.846 | 5.66/14.4 | 1.603/4.072 | 0.307/0.780 |
| 4 | 19 | 0.329/0.836 | 5.92/15.0 | 1.296/3.292 | 0.318/0.808 |
| 3 | 20 | 0.326/0.828 | 6.19/15.7 | 0.978/2.484 | 0.330/0.838 |
| 2 | 19 | 0.354/0.899 | 6.37/16.2 | 0.648/1.646 | 0.341/0.866 |
| 1 | 18 | 0.381/0.968 | 6.48/16.5 | 0.307/0.780 | 0.354/0.899 |
| 0 | 19 | 0.361/0.917 | 6.50/16.5 | 0.047/0.119 | —/— |
| 1' | 18 | 0.379/0.963 | 6.44/16.4 | 0.406/1.031 | 0.359/0.912 |
| 2' | 17 | 0.394/1.00 | 6.30/16.0 | 0.771/1.96 | 0.365/0.927 |
| 3' | 16 | 0.405/1.03 | 6.08/15.4 | 1.141/2.898 | 0.370/0.940 |
| 4' | 15 | 0.410/1.04 | 5.74/14.6 | 1.517/3.853 | 0.376/0.955 |
| 5' | 14 | 0.405/1.03 | 5.27/13.4 | 1.898/4.821 | 0.381/0.968 |
| 6' | 11 | 0.461/1.17 | 4.61/11.7 | 2.285/5.804 | 0.387/0.983 |
| 7' | 10 | 0.407/1.03 | 3.66/9.30 | 2.678/6.802 | 0.393/0.998 |
| 8' | 5 | 0.533/ | 2.13/ | 3.076/ | 0.398/ |

TABLE IV-continued

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| | | 1.35 | 5.42 | 7.813 | 1.011 |

The even numbered rows each had an orifice 71 positioned on the N-S axis while the odd numbered rows had orifices symmetrically spaced about the N-S axis without any orifices on the N-S axis. Orifice spacing 73 was 0.361 inch (0.917 cm.). Orifices 71 were Y-shaped on the discharge face of spinnerette 70 and had dimensions as in Example 1. In the narrow portion 74 of spinnerette 70 the perpendicular distance between rows going from N to S progressively increased per row an average of about 2.94 percent of orifice spacing 73; in the wide portion 75, the increase averaged about 1.54 percent of orifice spacing 73. The spacing of orifices per row going from N to S on an average progressively increased by about 3.95 percent of orifice spacing 73.

EXAMPLE 3

Orifices 81 of spinnerette 80 of the present invention (see FIG. 4) were arranged in three groups or patterns for the extrusion of three ends of yarn, each containing 192 filaments. The diameter of the wetted or circular area was 7.84 inches (19.9 cms.). The three groups of orifices 81 were separated by two parallel imperforate sections of spinnerette 80. The width of these imperforate sections (minimum distance from an orifice in either the right- or left-hand group to an orifice in the center group) was about 0.704 inch (1.788 cms.). Tables V and VI below set forth for each row in, respectively, left- and right-handed groups and the center group the number of orifices, spacing between the orifices, length of the row, the total distance from the row closest to the row designated 0, and the interval between that row and the adjacent row closer to the row designated 0 (or the 0 row).

TABLE V

Left- and Right-Handed Groups

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| 14 | 3 | 0.263/ 0.668 | 0.526/ 1.34 | 3.268/ 8.301 | 0.203/ 0.516 |
| 13 | 4 | 0.313/ 0.795 | 0.939/ 2.39 | 3.065/ 7.785 | 0.208/ 0.528 |
| 12 | 4 | 0.276/ 0.701 | 0.828/ 2.10 | 2.857/ 7.257 | 0.213/ 0.541 |
| 11 | 6 | 0.278/ 0.706 | 1.39/ 3.53 | 2.644/ 6.716 | 0.219/ 0.556 |
| 10 | 6 | 0.288/ 0.732 | 1.44/ 3.66 | 2.425/ 6.160 | 0.225/ 0.572 |
| 9 | 7 | 0.290/ 0.737 | 1.74/ 4.42 | 2.220/ 5.588 | 0.231/ 0.587 |
| 8 | 8 | 0.250/ 0.635 | 1.75/ 4.45 | 1.969 5.001 | 0.237 0.602 |
| 7 | 9 | 0.252/ 0.640 | 2.02/ 5.12 | 1.732/ 4.399 | 0.242/ 0.615 |
| 6 | 8 | 0.284/ 0.721 | 1.99/ 5.05 | 1.490/ 3.785 | 0.248/ 0.630 |
| 5 | 9 | 0.277/ 0.704 | 2.22/ 5.63 | 1.242/ 3.155 | 0.254/ 0.645 |
| 4 | 9 | 0.269/ 0.683 | 2.15/ 5.47 | 0.988/ 2.510 | 0.260/ 0.660 |
| 3 | 10 | 0.261/ 0.663 | 2/35 5.97 | 0.728/ 1.849 | 0.265/ 0.673 |

TABLE V-continued

Left- and Right-Handed Groups

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| 2 | 10 | 0.250/ 0.635 | 2.25/ 5.72 | 0.463/ 1.176 | 0.271/ 0.688 |
| 1 | 10 | 0.268/ 0.681 | 2.41/ 6.13 | 0.192/ 0.488 | 0.275/ 0.699 |
| 0 | 10 | 0.253/ 0.643 | 2.28/ 5.78 | 0.083/ 0.211 | — — |
| 1' | 10 | 0.267/ 0.678 | 2.40/ 6.10 | 0.364/ 0.925 | 0.281/ 0.714 |
| 2' | 10 | 0.247/ 0.627 | 2.22/ 5.65 | 0.650/ 1.651 | 0.286/ 0.726 |
| 3' | 10 | 0.256/ 0.650 | 2.30/ 5.85 | 0.940/ 2.388 | 0.290/ 0.737 |
| 4' | 9 | 0.260/ 0.660 | 2.08/ 5.28 | 1.234/ 3.134 | 0.294/ 0.747 |
| 5' | 9 | 0.263/ 0.668 | 2.10/ 5.34 | 1.532/ 3.891 | 0.298/ 0.757 |
| 6' | 8 | 0.261/ 0.663 | 1.83/ 4.64 | 1.834/ 4.658 | 0.302/ 0.767 |
| 7' | 7 | 0.297/ 0.754 | 1.78/ 4.53 | 2.140/ 5.436 | 0.306/ 0.777 |
| 8' | 6 | 0.284/ 0.721 | 1.42/ 3.61 | 2.450/ 6.223 | 0.310/ 0.787 |
| 9' | 5 | 0.281/ 0.714 | 1.12/ 2.85 | 2.764/ 7.021 | 0.314/ 0.797 |
| 10' | 3 | 0.610: 0.284/ 1.55: 0.721 | 0.894/ 2.27 | 3.082/ 7.828 | 0.318/ 0.808 |
| 11' | 2 | 0.281/ 0.714 | 0.281/ 0.714 | 3.404/ 8.646 | 0.322/ 0.818 |

Orifice spacing 83' for the left- and right-hand groups was 0.253 inch (0.643 cm.). Orifices 81 were circular on the discharge face of spinnerette 80 with a diameter of about 0.021 inch (0.053 cm.). In the narrow portion 84 of spinnerette 80 the perpendicular distance between rows of the left- and right-hand groups going from N to S progressively increased per row an average of about 2.19 percent of orifice spacing 83; in the wide portion 85, the increase averaged about 1.62 percent of orifice spacing 83.

TABLE VI

Center Group

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| 17 | 4 | 0.267/ 0.678 | 0.801/ 2.03 | 3.883/ 9.863 | 0.201/ 0.511 |
| 16 | 6 | 0.267/ 0.678 | 1.34/ 3.39 | 3.682/ 9.352 | 0.203/ 0.516 |
| 15 | 7 | 0.267/ 0.678 | 1.60/ 4.07 | 3.479/ 8.837 | 0.204 0.518 |
| 14 | 6 | 0.267/ 0.678 | 1.34/ 3.39 | 3.275/ 8.319 | 0.206/ 0.523 |
| 13 | 7 | 0.267/ 0.678 | 1.60/ 4.07 | 3.069/ 7.795 | 0.210/ 0.533 |
| 12 | 6 | 0.267/ 0.678 | 1.34/ 3.39 | 2.859/ 7.262 | 0.214/ 0.544 |
| 11 | 7 | 0.267/ 0.678 | 1.60/ 4.07 | 2.645/ 6.718 | 0.220/ 0.559 |
| 10 | 6 | 0.267/ 0.678 | 1.34/ 3.39 | 2.425/ 6.160 | 0.225/ 0.572 |
| 9 | 7 | 0.267/ 0.678 | 1.60/ 4.07 | 2.200/ 5.588 | 0.231/ 0.587 |
| 8 | 6 | 0.267/ 0.678 | 1.34/ 3.39 | 1.969/ 5.001 | 0.237/ 0.602 |
| 7 | 7 | 0.267/ 0.678 | 1.60/ 4.07 | 1.732/ 4.399 | 0.242/ 0.615 |

TABLE VI-continued

| Row | Number of Orifices | Orifice Spacing (inches/cms.) | Row Length (inches/cms.) | Row to Center Line (inches/cms.) | Row Spacing (inches/cms.) |
|---|---|---|---|---|---|
| | | Center Group | | | |
| 6 | 6 | 0.267/0.678 | 1.34/3.39 | 1.490/3.785 | 0.248/0.630 |
| 5 | 7 | 0.267/0.678 | 1.60/4.07 | 1.242/3.155 | 0.254/0.645 |
| 4 | 6 | 0.267/0.678 | 1.34/3.39 | 0.988/2.510 | 0.260/0.660 |
| 3 | 7 | 0.267/0.678 | 1.60/4.07 | 0.728/1.849 | 0.265/0.673 |
| 2 | 6 | 0.267/0.678 | 1.34/3.39 | 0.463/1.176 | 0.271/0.688 |
| 1 | 7 | 0.267/0.678 | 1.60/4.07 | 0.192/0.488 | 0.275/0.699 |
| 0 | 6 | 0.267/0.678 | 1.34/3.39 | 0.083/0.211 | —/— |
| 1' | 7 | 0.267/0.678 | 1.60/4.07 | 0.370/0.940 | 0.287/0.729 |
| 2' | 6 | 0.267/0.678 | 1.34/3.39 | 0.663/1.684 | 0.293/0.744 |
| 3' | 7 | 0.267/0.678 | 1.60/4.07 | 0.961/2.441 | 0.298/0.757 |
| 4' | 6 | 0.267/0.678 | 1.34/3.39 | 1.264/3.211 | 0.303/0.770 |
| 5' | 7 | 0.267/0.678 | 1.60/4.07 | 1.572/3.993 | 0.308/0.782 |
| 6' | 6 | 0.267/0.678 | 1.34/3.39 | 1.885/4.788 | 0.313/0.795 |
| 7' | 7 | 0.267/0.678 | 1.60/4.07 | 2.202/5.593 | 0.317/0.805 |
| 8' | 6 | 0.267/0.678 | 1.34/3.39 | 2.524/6.411 | 0.322/0.818 |
| 9' | 7 | 0.267/0.678 | 1.60/4.07 | 2.851/7.242 | 0.327/0.831 |
| 10' | 6 | 0.267/0.678 | 1.34/3.39 | 3.183/8.085 | 0.332/0.843 |
| 11' | 7 | 0.267/0.678 | 1.60/4.07 | 3.520/8.941 | 0.337/0.856 |
| 12' | 6 | 0.267/0.678 | 1.34/3.39 | 3.862/9.809 | 0.342/0.869 |

Orifice spacing 83 for the center group was 0.267 inch (0.678 cm.). Orifices 81 were identical to those of the left- and right-hand groups. In the narrow portion 84 of spinnerette 80 the perpendicular distance between rows of the center group going from N to S progressively increased per row an average of about 1.69 percent of orifice spacing 83; in the wide portion 85, the increase averaged about 1.87 percent of orifice spacing 83.

What is claimed is:

1. A spinnerette for use in a process in which one or more ends of individual filaments are extruded from a plurality of orifices of the spinnerette, said orifices for each end being arranged in a pattern which fills a predetermined circular area of the spinnerette, the pattern consisting of at least 5 substantially parallel rows, the orifices being substantially equispaced within a given row, the perpendicular distance between rows going from one side of the pattern to the other progressively increasing per row by an average of about 1 to 10 percent of the orifice spacing on the row closest to a line parallel to the rows and bisecting the pattern, the spacing of orifices per row going in the same direction on an average progressively increasing by from about 1 to 10 percent of said orifice spacing, said orifice spacing ranging from about 0.10 to 0.75 inch (about 0.25 to 1.9 centimeters), said orifices being positioned so that every other row has an orifice positioned at a distance from a line bisecting said pattern perpendicularly to the rows of within 25 to 50 percent of the spacing of the orifices on that row.

2. The spinnerette of claim 1 wherein the orifices are positioned so that the alternate every other row has an orifice positioned on said line bisecting said pattern perpendicular to the rows.

3. The spinnerette of claim 2 wherein said pattern is symmetrical with respect to said line bisecting said pattern perpendicular to the rows.

4. The spinnerette of claim 1 wherein the number of orifices ranges from 19 to 600.

5. The spinnerette of claim 1 wherein the diameter of said circular area ranges from about 3 to 12 inches (about 7.62 to 30.48 centimeters).

6. The spinnerette of claim 1 wherein the distance between rows progressively increases per row by about 1 to 5 percent of said orifice spacing.

7. The spinnerette of claim 1 wherein the spacing of orifices per row on an average progressively increases per row by about 1 to 5 percent of said orifice spacing.

8. A spinnerette for use in a process in which one or more ends of individual filaments are extruded from a plurality of orifices of the spinnerette, said orifices for each end being arranged in a pattern consisting of at least five substantially parallel rows, the orifices being substantially equispaced within a given row for substantially all of said rows, the distance between rows going from one side of the pattern to the other progressively increasing per row by an average of about 1 to 10 percent of the orifice spacing on the row closest to a line parallel to the rows and bisecting the pattern, the spacing of orifices within each row going from one side of at least one pattern to the other side on an average progressively increasing.

9. The spinnerette of claim 8 wherein the spacing of orifices within each row going from one side of at least one pattern to the other side on an average progressively increases by from about 1 to 10 percent of said orifice spacing.

10. The spinnerette of claim 8 wherein the orifices of at least one pattern are positioned so that every other row has an orifice positioned at a distance from a line bisecting said pattern perpendicularly to the rows of within 25 to 50 percent of the spacing of the orifices on that row.

11. The spinnerette of claim 10 wherein the orifices are positioned so that the alternate every other row has an orifice positioned on said line bisecting said pattern perpendicular to the rows.

12. The spinnerette of claim 11 wherein said pattern(s) are symmetrical with respect to said line bisecting said pattern perpendicular to the rows.

13. The spinnerette of claim 8 wherein the number of orifices ranges from 19 to 600.

14. The spinnerette of claim 9 wherein said pattern fills a circular area.

15. The spinnerette of claim 14 wherein the diameter of said circular area ranges from about 3 to 12 inches (about 7.62 to 30.48 cms.).

16. The spinnerette of claim 8 wherein said orifice spacing ranges from about 0.10 to 0.75 inch (about 0.25 to 1.9 cms.).

17. The spinnerette of claim 8 wherein the perpendicular distance between rows progressively increases per row by about 1 to 5 percent of said orifice spacing.

18. The spinnerette of claim 9 wherein the spacing of orifices per row on an average progressively increases by about 1 to 5 percent of said orifice spacing.

19. The spinnerette of claim 9 wherein said pattern fills a circular area of the spinnerette and wherein the arrangement of said orifices is determined according to a method consisting essentially of the steps of:

(1) Solving for X in the equation:

$$3X^2+3X-(Nt-1)=0$$

where Nt is the number of spinnerette orifices;

(2) Determining the average hole spacing (Sa) from:

$$Sa=D/2X$$

where D is the diameter of the circular area;

(3) Determining the average spacing between rows Sr from:

$$Sr=1.05Sa;$$

(4) Determining the average spacing between orifices in the rows Sh from:

$$Sh=0.95Sa;$$

(5) Determining each interval between rows ΔSr(w) for the wide portion from:

$$\Delta Sr(w)=(1+0.015N)Sr$$

where N is the number of rows away from the row closest to the line parallel to the rows and bisecting the pattern;

(6) Determining each interval between rows ΔSr(V) for the narrow portion from:

$$\Delta Sr(V)=(1-0.35N)Sr;$$

(7) Determining the total distance Rn for each row from the line parallel to the rows and bisecting the pattern from:

$$Rn = \sum_{o}^{n} \Delta Sr;$$

(8) Determining the length Ln of each row from:

$$Ln = 2\sqrt{\left(\frac{D^2}{4}\right) - Rn^2};$$

(9) Determining the approximate orifice spacing Sn on each row for the wide portion from:

$$Sn(W)=0.95Sa(1+0.025N);$$

(10) Determining the approximate orifice spacing Sn on each row for the narrow portion from:

$$Sn(V)=0.95Sa(1-0.025N);$$

(11) Determining the approximate number of orifices Nn on each row from:

$$Nn=(Ln/Sn)+1;$$

(12) Rounding off Nn to the nearest whole number to obtain Nn(exact) consistent with the rule:
Nn(exact) is an even number for odd rows, and
Nn(exact) is an odd number for even rows, where the row closest to a line parallel to the rows and bisecting the pattern is considered the zero row, which is even, and the other rows are numbered therefrom for both the narrow and wide portions;

(13) Determining the exact orifice spacing Sn(exact) for each row from:

$$Sn(\text{exact}) = \frac{Ln}{Nn(\text{exact}) - 1}; \text{ and}$$

(14) Comparing Sn(exact) with the predicted Sn and if Sn(exact) and the predicted Sn vary by greater than plus or minus 10 percent, then increasing or decreasing Nn to the next nearest whole number consistent with the rule of Step 12.

* * * * *